United States Patent [19]

Grooms

[11] Patent Number: 4,811,918

[45] Date of Patent: Mar. 14, 1989

[54] METHOD AND APPARATUS FOR INSTALLING CONTINUOUS LENGTHS OF MATERIAL

[76] Inventor: Joseph J. Grooms, P.O. Box 9367, Charleston, S.C. 29410

[21] Appl. No.: 127,515

[22] Filed: Dec. 1, 1987

Related U.S. Application Data

[63] Continuation of Ser. No. 869,617, Jun. 2, 1986, abandoned.

[51] Int. Cl.[4] ..... B65H 19/04

[52] U.S. Cl. ..... 242/55.2; 242/75.2; 242/96; 242/153

[58] Field of Search ..... 242/55.2, 55, 75.2, 242/96, 153, 68.4; 140/207, 208, 209

[56] References Cited

U.S. PATENT DOCUMENTS

| | | | |
|---|---|---|---|
| 301,259 | 7/1884 | Newton | 140/108 |
| 409,447 | 8/1889 | Block | 242/75.2 |
| 437,951 | 10/1890 | Ulsh | 140/109 |
| 485,109 | 10/1892 | Morrow | 242/68.4 |
| 968,476 | 8/1910 | Hollandsworth | 242/55.2 |
| 1,341,484 | 5/1920 | Starratt | 242/68.4 |
| 1,410,136 | 3/1922 | Stevens | 242/55.2 |
| 1,513,850 | 11/1924 | Morton | 242/68.4 |
| 1,713,809 | 5/1929 | Allee | 140/109 |
| 4,097,002 | 6/1978 | Krueger | 242/55.2 |

FOREIGN PATENT DOCUMENTS

| | | | |
|---|---|---|---|
| 652307 | 3/1929 | France | 242/55.2 |
| 14408 | of 1892 | United Kingdom | 242/55.2 |

*Primary Examiner*—Stanley N. Gilreath
*Assistant Examiner*—Katherine Matecki
*Attorney, Agent, or Firm*—Dority & Manning

[57] ABSTRACT

A device for allowing screen to be unrolled from a roll and applied to an open frame while simultaneously maintaining constant tension across the width of the screen. A roll friction bar is provided which extends closely parallel to the circumferential surface of the roll of screen. The roll friction bar is attached to the roll by insertion into the axial openings typically found in rolls of screen material. The free end of the roll of screen is brought around the roll friction bar, doubled back over the screen still on the roll, and fixedly attached to the open frame. The installer then unwinds a desired amount of screen from the roll. By grasping the roll with one hand, the installer is able to both prevent screen from further unwinding from the roll and maintain constant tension across the width of screen being applied.

9 Claims, 3 Drawing Sheets

METHOD AND APPARATUS FOR INSTALLING CONTINUOUS LENGTHS OF MATERIAL

This is a continuation of application Ser. No. 869,617, filed June 2, 1986, which was abandoned upon the filing hereof.

BACKGROUND OF THE INVENTION

The present invention relates to a roll friction bar device which allows uniform tensioning of material being unwound from a roll as the material is being attached to a surface.

When installing web material such as screening from a roll to an open frame structure, such as a window frame or a door frame, it often becomes difficult to achieve uniform tensioning of the screen across the entire width of the screen. This is true especially if the installer has only one hand available to grab and pull the roll of screen to make the screen taut as the screen is fastened down. Simply grasping the roll in the middle or on an end usually does not allow uniform tensioning to be achieved across the width of the screen. However, if the installer must use both hands to pull the roll in order to fasten the screen, the screen installation process becomes a two-man operation as one man will be required to pull the screen taut and another to fasten the screen down.

Because the fastening down of the screen usually requires the use of only one hand, when done with a staple gun or other similar type fastening machine, it would be desirable to provide a means by which the screen could be pulled uniformly taut with one hand, thereby freeing the other hand for fastening. Thus, only one person would be required to install screen.

There are several patented tensioning devices for installing screen such as those disclosed in U.S. Pat. No. 301,844 granted to Wolcott and U.S. Pat. No. 437,951 granted to Ulsh. Those patented devices, however, use ratchet means attached to a roll of screen to tension the screen as it is installed. Such a ratchet means is impractical for one-handed operation. Hand-held devices for use in tensioning screen wire on an open frame are disclosed in U.S. Pat. Nos. 2,146,629 granted to Jauch et al., 2,587,889 granted to Picton, and 2,818,887 granted to Esrey. However, none of those patented hand-held devices operate in the same simple, manageable manner as does a roll friction bar constructed in accordance with the present invention.

SUMMARY OF THE INVENTION

The present invention is comprised of an elongated roll friction bar which spans across the length of the circumferential surface of a roll of material such as screen. The roll friction bar is held to the roll of material by two roll insertion members attached to the roll friction bar, one at each end. The roll insertion members are inserted along the central axis of the roll of material, with one roll insertion member being inserted into each end of the roll of material.

Upon placing the roll friction bar onto a roll of screen, the free end of the screen is brought around the roll friction bar and doubled back upon the screen remaining, still unwound, on the roll and is attached to an end of a structure to which the screen is to be secured. After a desired length of the screen has been unwound from the roll, passing around the roll friction bar in so doing, the roll of screen is firmly grasped, preferably in the middle, and pulled away from the now attached free end to make taut the screen already unwound. The roll friction bar, by doubling the screen back upon itself, creates enough frictional contact between the screen being unwound and the screen remaining on the roll to allow for a person to easily control the unwinding of the screen through contact therewith by his or her hand, knee, or torso. The roll friction bar also causes the screen to be pulled evenly and tightly thereacross, without wrinkling, to uniformly tension the full width of the screen as the screen is being installed.

One embodiment of the present invention has an elongated slot adjacent each end of the roll friction bar and also an elongated slot on each of the roll insertion members to allow for the roll friction bar to be adjusted for different size rolls and for maximum effectiveness. Another embodiment of the present invention has a telescoping roll friction bar along with a slot on each of the roll insertion members to also allow for the roll friction bar to be adjusted for different size rolls and for maximum effectiveness.

It is therefore an object of the present invention to provide a device which allows one person to efficiently apply screen from a roll to a surface.

Another object of the present invention is to provide a device which allows uniform tension to be applied across the width of web material being unwound from a roll.

Still another object of the present invention is to provide a device which allows simple, one-handed control of the unwinding of a web material from a roll.

Yet another object of the present invention is to provide a material tensioning device which is readily adjustable for accommodating different size rolls of material.

BRIEF DESCRIPTION OF THE DRAWINGS

The foregoing as well as other objects of the present invention will be more apparent from the following detailed description of the preferred embodiment of the invention when taken together with the accompanying drawings, in which.

DESCRIPTION OF THE INVENTION

Figure 1:
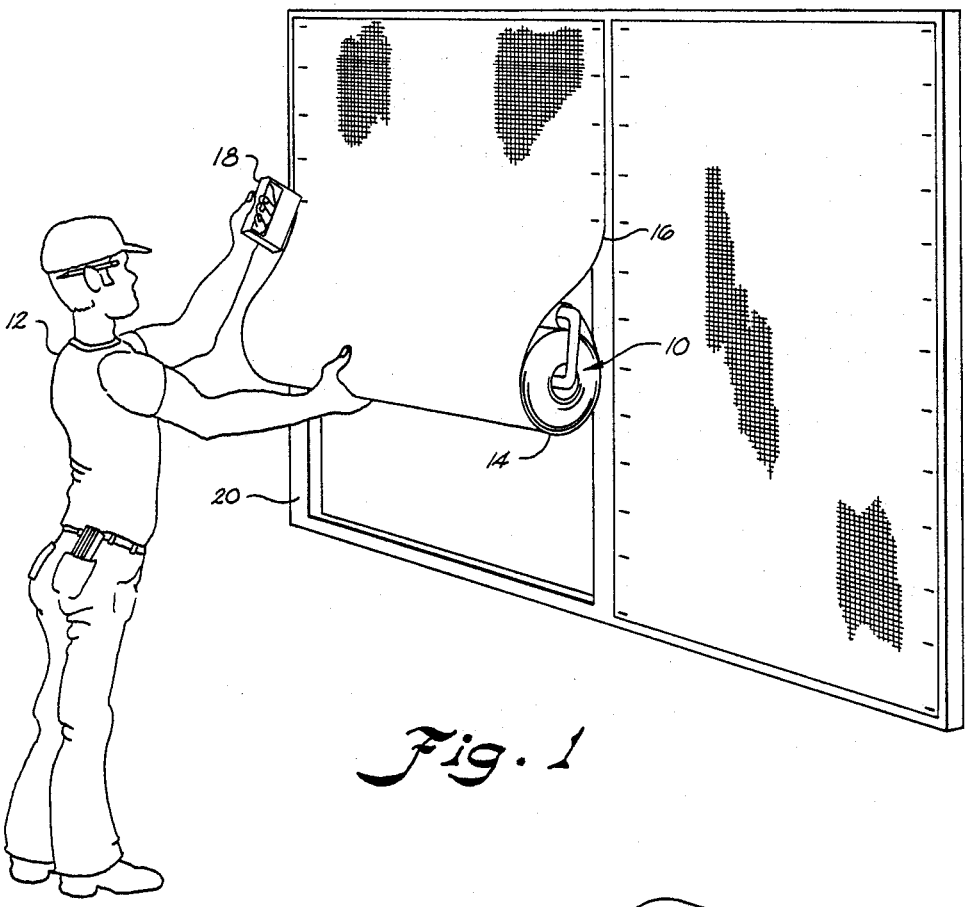
FIG. 1 is a side-elevational view of a preferred form of a roll friction bar being used by an installer to install screen on open frames.

The present invention, depicted generally as 10, is shown in use in FIG. 1. An installer 12 operates the device 10, installed in roll 14 of screen 16, with one hand while using a staple gun 18 or some other similar fastening machine to fasten screen 16 down to open frame 20. Open frame 20 could be a window frame, door frame, etc.

Figure 2:
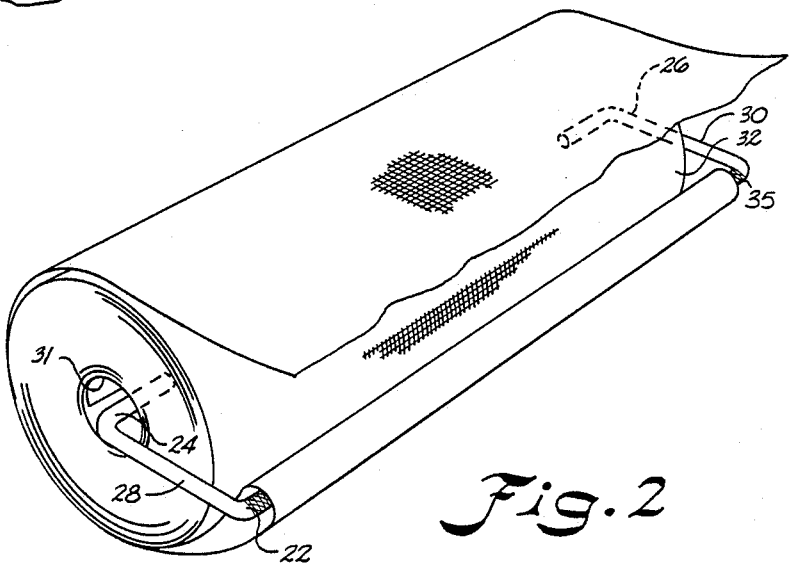
FIG. 2 is a perspective view of the preferred form of a roll friction bar.

In FIG. 2, device 10 is illustrated as comprising an elongated body member, or roll friction bar 22, two roll insertion members 24, 26, and two connecting members 28, 30. Roll insertion members 24, 26 are inserted into the axial openings 31 typically found in a roll 14, to hold roll friction bar 22 closelly parallel to the circumferential surface 32 of roll 14. A connecting member 28, 30 is attached to each end of roll friction bar 22. Connecting members 28, 30 span between the roll insertion members 24, 26, respectively, and extend substantially perpendicularly to roll friction bar 22. A roll insertion member 24, 26 is attached to an end of each connecting member 28, 30, opposite roll friction bar 22. Roll insertion members 24, 26 extend coaxially toward one another in a direction substantially parallel to the longitudinal extent of roll friction bar 22.

Figure 2A:
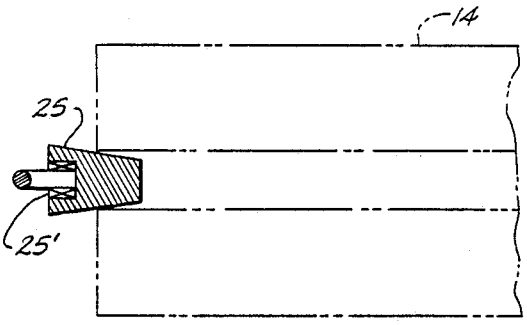
FIG. 2A is a cross-sectional side elevation view of an alternate embodiment of a roll friction bar constructed in accordance with the present invention.

As shown in FIG. 2A, roll insertion members 24, 26 may have a conical or other shaped adaptor 25 received on an end of same. Adaptor 25 would thus be received within inside opening 30 of roll 14, thus providing a snug-fitting relationship. Since roll 14 must turn during operation, adaptor 25 preferably includes a bearing member 25' which is received over member 24 for rotary movement thereabout.

The device 10 can be made of any suitable material such as wood, metal, or plastic and can be made entirely integral or of several parts. Besides being used to install screen 16, the device 10 could be used to apply a wide variety of web materials from a roll to a surface where constant tension across the width of the web is required during application.

Figure 2B:
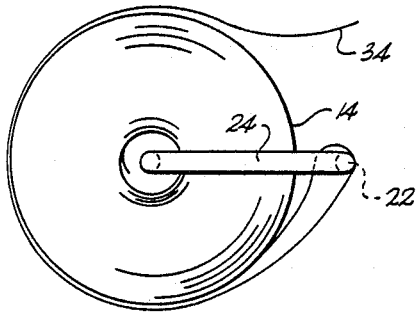
FIG. 2B is an end view of the preferred form of a roll friction bar.

The method of operation of device 10 is practiced by first inserting roll insertion members 24, 26 into the respective axial openings 31 of the roll 14 of screen 16. The free end 34 of screen 16 on roll 14 is brought between the roll friction bar 22 and the roll 14. Free end 34 is then brought back around roll friction bar 22 and underneath roll 14 in a manner as shown in FIG. 2B and in FIG. 2. Thereafter, a desired length of screen 16 is unwound from roll 14, passing over roll friction bar 22 in so doing. The free end 34 is attached to one end of the open frame 20, which is to be covered with the screen 16. Next, roll 14 is grasped with one or two hands and is pulled away from where free end 34 has been attached, so that the unwound portion of screen 16 is uniformly taut across its width.

Roll friction bar 22 causes screen 16 to double over upon itself as it passes in a highly frictional sliding manner around roll friction bar 22. Because of the frictional sliding of screen 16 back over itself during unwinding, installer 12 can readily control the amount of screen 16 unwound from roll 14. The installer 12 controls the amount of frictional contact between the doubled-over screen 16 by grasping and applying pressure to the circumferential surface 32 of roll 14 with one hand, or by bracing roll 14 with a knee or the front side of his or her body against a stationary surface. Not only does device 10 allow the operator to control the amount of screen 16 withdrawn from the roll 14, device 10 also allows installer 12 to achieve constant tension in screen 16 across its width. Screen 16 is held flat and unwrinkled as it passes over roll friction bar 22, which acts to deliver constant force across the width of screen 16 while installer 12 pulls roll 14 away from the attached free end 34. A roughened or knurled surface 35 can be provided on roll friction bar 22 to increase the frictional contact between screen 16 and roll friction bar 22. The increased frictional contact would allow installer 12 to have more control over the unwinding of screen 16 from roll 14.

Figure 3:
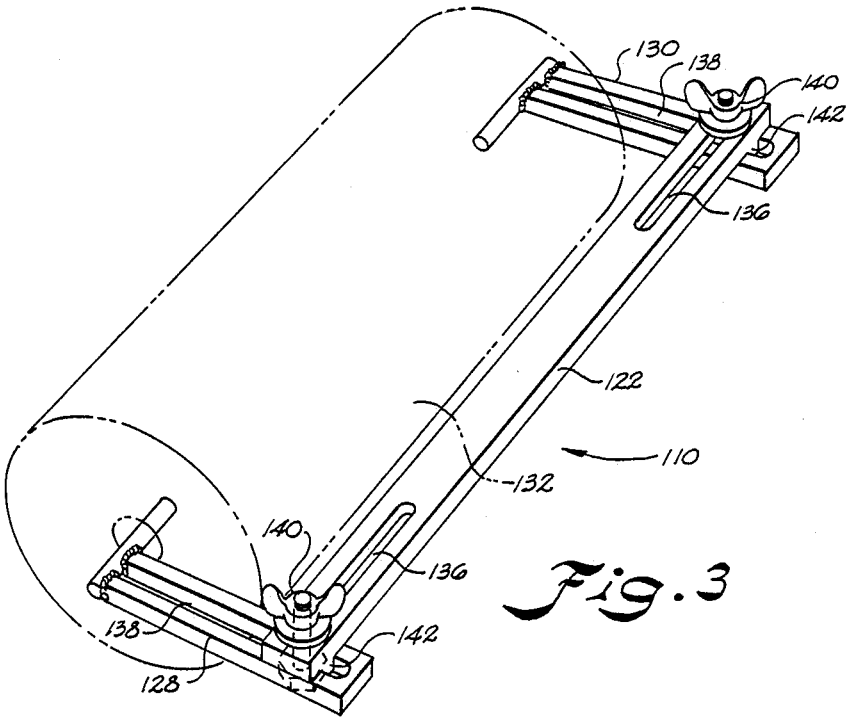
FIG. 3 is a perspective view of an alternate embodiment of a roll friction bar constructed in accordance with the present invention.
Figure 4:
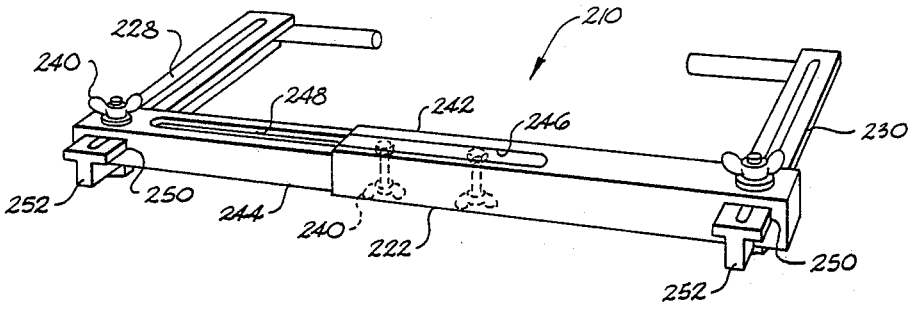
FIG. 4 is a perspective view of an alternate embodiment of a roll friction bar constructed in accordance with the present invention.

Alternate embodiments of the present invention as illustrated in FIGS. 3 and 4 are readily adjustable during use for different size rolls of screen 16 or other materials.

As illustrated in FIG. 3, an alternate embodiment of the present invention comprises an elongated body member or roll friction bar 122 which has an elongated slot 136 in each end. Each elongated slot 136 extends substantially parallel to the longitudinal extent of roll friction bar 122. Two connecting members 128, 130 are connected to roll friction bar 122, adjacent each end of roll friction bar 122. Each connecting member 128, 130 defines an elongated slot 138 which extends substantially parallel to the longitudinal extent of each connecting member 128, 130 and substantially perpendicularly to roll friction bar 122. A suitable releasable fastener such as a wingnut/bolt combination 140 is provided to allow adjustment of the device 110 for different size rolls of web material such as screen. By simply releasing the wingnut/bolt combination 140, a wide range of roll 14 sizes can be accommodated with device 110. Downwardly extending rails or tabs 142 are provided on connecting members 128, 130 to prevent rotation of the connecting members 128, 130 relative to roll friction bar 122. If desired, roll friction bar 122 can even be moved tightly against the circumferential surface 32 of a roll 14 to prevent further unwinding of web material carried thereon.

As illustrated in FIG. 4, another alternate embodiment of the present invention comprises a telescoping roll friction bar 222 having an outer channel member 242 in which an inner channel member 244 slides freely. Grooves 246, 248 are carried in outer channel member 242 and second channel member 244, respectively, to allow releasable fastening members, such as wingnut/bolt combinations 240, to be received therein. Wingnut/bolt combinations 240 are recessed within groove 246 to prevent the screen from being damaged thereby as the screen is drawn across roll friction bar 222. Inner channel member 244 slides freely within outer channel member 242, but can be locked with respect to outer channel member 242 by tightening wingnut/bolt combinations 240. This allows for the roll friction rod to be adjusted for the width of a particular roll 14.

Instead of wingnut/bolt combinations 240, inner channel member having compressible side walls (not shown) could be frictionally held in outer channel member 242. The sidewalls of the inner channel member would be squeezed together as the inner channel is inserted into outer channel member 242. Then, upon proper insertion into outer channel member 242, the sidewalls would be released to spring outwardly for frictional retention within outer channel member 242.

A transverse running groove 250, shown as being T-shaped in FIG. 4, is carried in each end of roll friction bar 222 and mates with a corresponding cross-sectional profile 252, shown as being complementarily T-shaped in FIG. 4, of each connecting member 228, 230. Each connecting member 228, 230 carries an elongated slot 238 which extends substantially parallel to the longitudinal extent of each connecting member 228, 230. A releasable fastening means such as wingnut/bolt combination 240 allows a connecting member 228, 230 to be moved relative to roll friction bar 228 and then fixed to roll friction bar 222 by wingnut/bolt combination 240.

This allows for device 210 to be adjusted both for rolls of different widths and for rolls of different diameters.

Alternate embodiment devices 110, 210 illustrated in FIGS. 3 and 4 perform in the same manner during installation of screen or other web material as does the preferred embodiment device 10. Dimensonal markings, such as engravings or appliques (not shown) could be provided on connecting members 128, 130, 228, 230 and roll friction bar 122, 130 to allow easy matching adjustment of each connecting member relative to the roll friction bar. Such dimensional markings would preferably be in increments of fractions of inches or in increments of fractions of centimeters.

While a preferred embodiment of the invention has been described using specific terms, such description is for illustrative purposes only, and it is to be understood that changes and variations may be made without departing from the spirit or scope of the following claims.

What is claimed is:

1. An apparatus for unwinding material from a full-width roll of such material so that substantially uniform tension is maintained, while stretching the material onto a surface for attachment thereto, across the width of such roll of material, said apparatus comprising:

an elongated friction bar having a width about that of the roll of material, and having respective ends;

first and second insertion members adapted for receipt in respective ends of the roll of material, said insertion members collectively defining a rotational axis with such roll of material freely rotatable about such axis;

first and second connection members physically interconnecting respective ends of said friction bar with said insertion members, respectively, whereby such material may be doubled back and encircled about said friction bar and drawn-off with tension uniformly distributed across the width thereof due to the encirclement thereof about said friction bar and the friction at such friction bar and the surface of unwound material, such friction occurring by the free rotation of the roll of material about said rotational axis;

connection member adjustment means for allowing the distance between said first and said second insertion members and said elongated bar to be varied during use to correspond to the diameter of a given roll of material; and elongated friction bar adjustment means carried by said elongated friction bar for allowing the distance between said first connection member and said second connection member to be readily varied to correspond to the width of a given roll of material; wherein:

at least one of said connection members is separate from said elongated bar;

said elongated bar defines an elongated slot therein adjacent at least one of said respective ends; and releasable fastener means are provided to secure at least one of said connection members to said elongated bar along said elongated slot.

2. An apparatus for unwinding material from a full-width roll of such material so that substantially uniform tension is maintained, while stretching the material onto a surface for attachment thereto, across the width of such roll of material, said apparatus comprising:

an elongated friction bar having a width about that of the roll of material, and having respective ends;

first and second insertion members adapted for receipt in respective ends of the roll of material, said insertion members collectively defining a rotational axis with such roll of material freely rotatable about such axis;

first and second connection members physically interconnecting respective ends of said friction bar with said insertion members, respectively, whereby such material may be doubled back and encircled about said friction bar and drawn-off with tension uniformly distributed across the width thereof due to the encirclement thereof about said friction bar and the friction at such friction bar and the surface of unwound material, such friction occurring by the free rotation of the roll of material about said rotational axis; and connection member adjustment means for allowing the distance between said first and said second insertion members and said elongated bar to be varied during use to correspond to the diameter of a given roll of material; wherein:

said connection member adjustment means includes a first elongated slot defined by said connection member and a second elongated slot defined by said second connection member;

each said first and second elongated slot allows sliding movement of the respective said first and second connection member relative to said elongated bar; and releasable fastener means are provided for selectively fixing said first connection member and said second connection member relative to said elongated bar.

3. An apparatus as defined in claim 2, further comprising:

elongated bar adjustment means for allowing the distance between said first connection member and said second connection member to be readily varied to correspond to the width of such given roll of material, said elongated bar being defined by first and second body sections and wherein said elongated bar adjustment means includes:

(i) a first elongated channel member forming a portion of said first body section;

(ii) a second elongated channel member forming a portion of said second body section being slidably connectable with and relative to said first elongated channel member; and (iii) releasable fastener means for selectively fixing said second elongated channel member relative to said first elongated channel member.

4. An apparatus for unwinding material from a full-width roll of such material so that substantially uniform tension is maintained, while stretching the material onto a surface for attachment thereto, across the width of such roll of material, said apparatus comprising:

an elongated friction bar having a width about that of the roll of material, and having respective ends;

first and second insertion members adapted for receipt in respective ends of the roll of material, said insertion members collectively defining a rotational axis with such roll of material freely rotatable about such axis;

first and second connection member physically interconnecting respective ends of said friction bar with said insertion members, respectively, whereby such material may be doubled back and encircled about said friction bar and drawn off with tension uniformly distributed across the width thereof due to the encirclement thereof about said friction bar and the friction at such friction bar and the surface of unwound material, such friction occurring by the free rotation of the roll of material about said rotational axis; and connection member adjustment means for allowing the distance between said first and second insertion members and said elongated bar to be adjustably and rigidly securably varied during use to correspond to the diameter of a given roll of material.

5. An apparatus as in claim 4, wherein said interconnecting of said connection members with said bar and said insertion members comprises substantially rigid couplings so that no inward force is applied to said insertion members, thereby preserving freedom of rotation about said insertion member for any roll of material receiving same.

6. An apparatus as defined in claim 4, further comprising:

elongated friction bar adjustment means carried by said elongated friction bar for allowing the distance between said first connection member and said second connection member to be readily varied to correspond to the width of a given roll of material.

7. An apparatus as defined in claim 6, wherein said elongated friction bar is defined by first and second body sections and wherein said elongated friction bar adjustment means comprises:

a first elongated channel member forming a portion of said first body section;

a second elongated channel member forming a portion of said second body section and being frictionably connectable with said first elongated channel member.

8. An apparatus as defined in claim 6, wherein said elongated bar is defined by first and second body sections and wherein said elongated bar adjustment means comprises:

a first elongated channel member forming a portion of said first body section;

a second elongated channel member forming a portion of said second body section and being slidably connectable with and relative to said first elongated channel member; and releasable fastener means for selectively fixing said second elongated channel member relative to said first elongated channel member.

9. An apparatus for unwinding material from a full-width roll of such material so that substantially uniform tension is maintained, while stretching the material onto a surface for attachment thereto, across the width of such roll of material, said apparatus comprising:

an elongated friction bar having a width about that of the roll of material, having respective ends, and having a frictional-characteristic surface for frictionally engaging material passed thereover;

first and second insertion members adapted for receipt in respective ends of the roll of material, said insertion members collectively defining a rotational axis with such roll of material freely rotatable about such axis; and first and second connection members physically interconnecting respective ends of said friction bar with said insertion members, respectively, whereby such material may be doubled back and encircled about said friction bar and drawn off with uniform tension across its full width due to friction at such friction bar and at the doubled back drawn-off material by the free rotation of the roll of material about said rotational axis; and connection member adjustment means for allowing the distance between said first and second insertion members and said elongated bar to be adjustably and rigidly securably varied during use to correspond to the diameter of a given roll of material.

* * * * *